US008656726B2

(12) United States Patent
Pozivil

(10) Patent No.: US 8,656,726 B2
(45) Date of Patent: Feb. 25, 2014

(54) NATURAL GAS SUPPLY METHOD AND APPARATUS

(75) Inventor: Josef Pozivil, Allschwil (CH)

(73) Assignee: Cryostar SAS, Hesingue (FR)

( * ) Notice: Subject to any disclaimer, the term of this patent is extended or adjusted under 35 U.S.C. 154(b) by 1175 days.

(21) Appl. No.: 11/795,665

(22) PCT Filed: Jan. 18, 2006

(86) PCT No.: PCT/EP2006/000410

§ 371 (c)(1),
(2), (4) Date: Apr. 2, 2008

(87) PCT Pub. No.: WO2006/077094

PCT Pub. Date: Jul. 27, 2006

(65) Prior Publication Data

US 2009/0126400 A1 May 21, 2009

(30) Foreign Application Priority Data

Jan. 21, 2005 (GB) ..... 0501335.4

(51) Int. Cl.
*F17C 9/02* (2006.01)
*F25B 5/00* (2006.01)
*F25J 1/00* (2006.01)

(52) U.S. Cl.
USPC ..... 62/50.2; 62/200; 62/611

(58) Field of Classification Search
USPC ..... 62/50.1–5, 611, 618; 122/448.1
See application file for complete search history.

(56) References Cited

U.S. PATENT DOCUMENTS

| | | | | |
|---|---|---|---|---|
| 6,449,983 | B2 | 9/2002 | Pozivil | |
| 6,530,241 | B2 | 3/2003 | Pozivil | |
| 6,598,423 | B1 * | 7/2003 | Emmer et al. | 62/614 |
| 6,598,564 | B2 * | 7/2003 | Gerstendorfer et al. | 122/448.1 |
| 7,497,180 | B2 * | 3/2009 | Karlsson et al. | 114/74 R |

FOREIGN PATENT DOCUMENTS

| | | |
|---|---|---|
| EP | 1 291 576 A2 | 3/2003 |
| JP | 2005-282998 | 4/2004 |
| JP | 2004-183604 | 7/2004 |
| WO | WO 94/17325 | 8/1994 |
| WO | WO 2005/058692 A1 | 6/2005 |
| WO | WO 2005/087586 A1 | 9/2005 |

OTHER PUBLICATIONS

U.S. Appl. No. 10/569,379, filed Sep. 1, 2004, Pozivil.
U.S. Appl. No. 10/582,903, filed Jan. 13, 2005, Pozivil et al.

* cited by examiner

*Primary Examiner* — Khoa Huynh
*Assistant Examiner* — Timothy K Trieu
(74) *Attorney, Agent, or Firm* — Joshua L. Cohen

(57) ABSTRACT

A primary stream of boiled-off natural gas taken from the ullage space of a liquefied natural gas storage vessel is compressed by a compressor. A flow of liquefied natural gas taken from the storage vessel is partially and forcedly vaporised in a vaporiser 36 so as to form a secondary stream of natural gas containing unvaporised liquefied natural gas. Unvaporised liquefied natural gas is disengaged from the secondary stream in a phase separator. The secondary stream is mixed with the compressed primary stream to form a supply of natural gas fuel. The fuel supply may be formed and used on board an ocean-going LNG tanker.

2 Claims, 1 Drawing Sheet

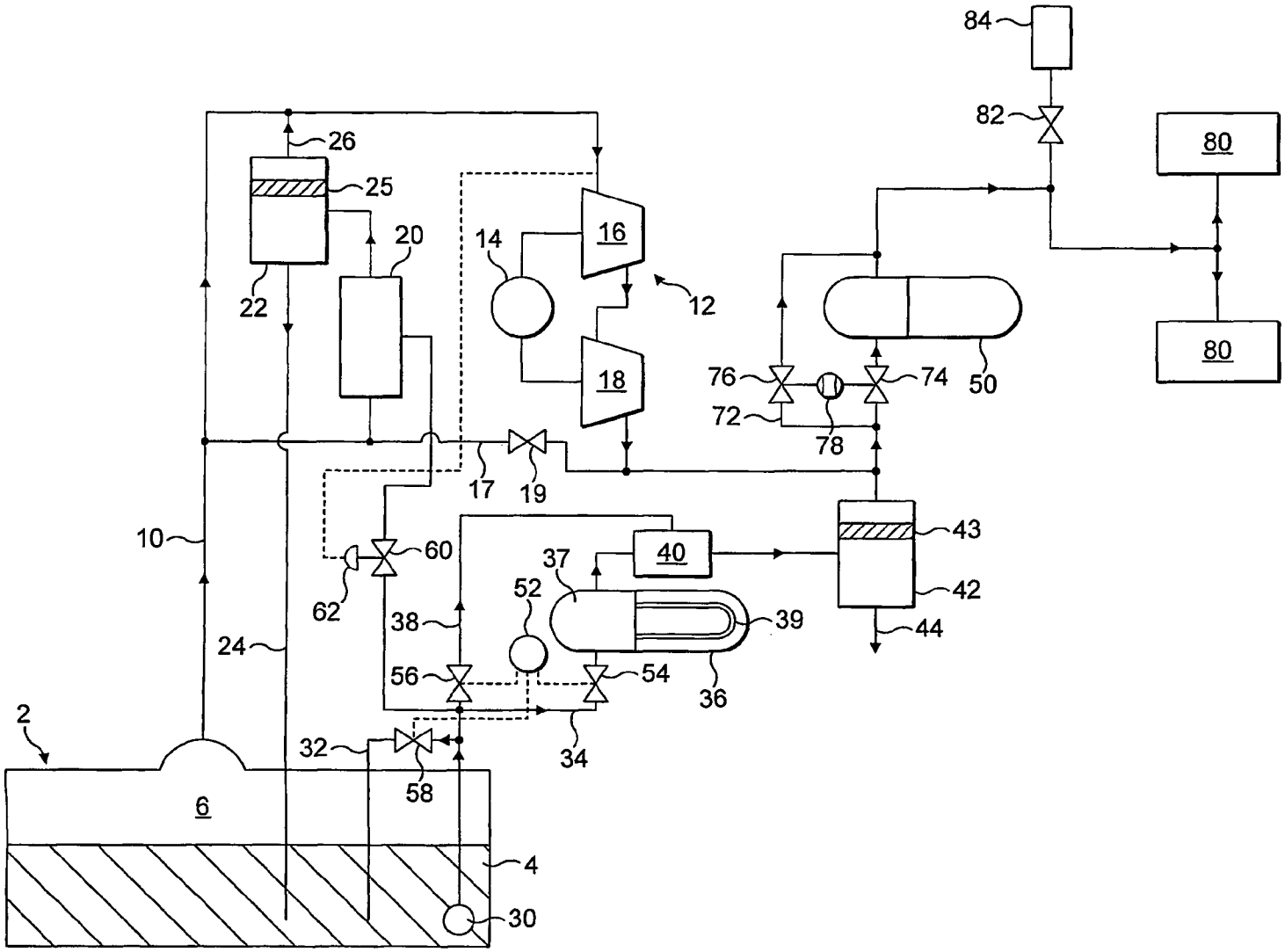
80
80
84
82
50
74
78
76
72
43
42
44
39
36
40
54
34
37
52
12
16
18
14
19
17
4
30
60
38
56
58
62
32
20
25
26
22
24
10
6
2

NATURAL GAS SUPPLY METHOD AND APPARATUS

CROSS REFERENCE TO RELATED APPLICATIONS

This application claims priority from International Patent Application Serial No. WO 2006/077094 A1, filed Jan. 18, 2006, which claims priority from British Patent Application Serial No. 0501335.4, filed Jan. 21, 2005.

BACKGROUND OF THE INVENTION

This invention relates to a method of an apparatus for supplying natural gas fuel for the purposes of heating or power generation. The method and apparatus according to the invention are particularly suitable for use on board ship for the purpose of providing fuel to the ship's engines.

EP 1 291 576 A relates to apparatus for supplying natural gas fuel (the principal component of which is methane) to heat the boilers of an ocean-going tanker for the transport of LNG. The apparatus comprises a compressor having an inlet communicating with the ullage space of at least one LNG storage tank and an outlet communicating with a conduit leading from the compressor to fuel burners associated with the boilers, and a forced LNG vaporiser having an inlet communicating with a liquid storage region of the said tank and an outlet communicating with the same or a different conduit leading to fuel burners associated with the conduit. The forced gas vaporiser is able to supplement the fuel provided by natural boil-off of the liquefied natural gas.

In principle, the apparatus according to EP 1 291 576 A may be adapted to supply fuel for any need on board the ship. Some modern LNG tankers employ engines that can be run on either diesel or natural gas. The presence of higher hydrocarbons in the natural gas can, however, cause the engine to knock.

The present invention relates to a method and apparatus that address this problem.

BRIEF SUMMARY OF THE INVENTION

According to the present invention there is provided a method of supplying natural gas fuel comprising the steps of compressing a primary stream of boiled-off natural gas taken from the ullage space of a liquefied natural gas storage vessel, partially and forcedly vaporising a flow of liquefied natural gas taken from a storage vessel so as to form a secondary stream of natural gas containing unvaporised liquefied natural gas, disengaging the unvaporised liquefied natural gas from the secondary stream, and mixing the secondary stream with the compressed primary stream.

The invention also provides apparatus for supplying natural gas fuel comprising a compressor having an inlet for a primary stream of natural gas communicating with the ullage space of at least one liquefied natural gas storage vessel and an outlet communicating with a natural gas supply stream, a forced liquefied natural gas partial vaporiser means having an inlet for a secondary stream of natural gas communicating with a liquid storage region of the said or a different liquefied natural gas storage vessel and an outlet able to be placed in communication with the said natural gas supply pipe, the said partial vaporiser means being operatively associated with means for disengaging unvaporised liquid natural gas from the vaporised natural gas.

Preferably, the partial vaporisation is effected by fully vaporising and superheating a first part of said flow of liquefied natural gas and mixing the resulting vapour with a second part of said flow of liquefied natural gas.

Preferably, the temperature, flow rate and composition of the secondary stream of natural gas are controlled. By this means, it can be ensured that the supply rate and composition of the natural gas fuel meet the demands of the engine or engines to which it is supplied.

A preferred apparatus according to the invention includes a programmable logic controller operatively associated with the forced partial vaporiser means. The programmable logic controller preferably includes an algorithm for determining the temperature at which the forced partial vaporiser means is operated. Hence the compositions of the unliquefied natural gas and the vaporised natural gas can be determined.

Preferably the forced partial vaporiser means includes a vaporisation chamber having heat transfer means, an inlet to the vaporisation chamber for the liquefied natural gas, a mixing chamber downstream of the vaporisation chamber, a first inlet to the mixing chamber communicating with an outlet from the vaporisation chamber, a second inlet to the mixing chamber communicating with a source of liquefied natural gas, and valve means for controlling the relative flows of liquefied natural gas to the vaporisation chamber and the mixing chamber.

Preferably there is a gas heater in the said natural gas supply pipe operable to raise the natural gas to a chosen temperature.

The method and apparatus according to the invention are particularly suited for operation on board a ship or ocean-going tanker for transporting LNG from port to port.

BRIEF DESCRIPTION OF THE DRAWING

The method and apparatus according to the invention will now be described by way of example with reference to the accompanying drawing which is a schematic flow diagram of an LNG storage tank and associated equipment for the supply of natural gas from the tank.

DETAILED DESCRIPTION OF THE INVENTION

Referring to the drawing, an LNG storage vessel or tank 2 is located on board an ocean-going tanker (not shown). The storage tank 2 is thermally-insulated so as to keep down the rate at which its contents, LNG, absorbs heat from the surrounding environment. The storage tank is shown in the drawing FIGURE as charged with a volume 4 on LNG. There is naturally an ullage Space 6 above the liquid level in the storage tank 2. Since LNG boils at a Temperature well below ambient, notwithstanding the thermal insulation of the tank 2, there is a continuous evaporation of the LNG from the volume 4 into the ullage space 6. This evaporated natural gas is employed as a fuel in the tanker's engines 80 or otherwise on board ship. To this end, there is a continuous withdrawal by a compressor 12 of the evaporated natural gas from the ullage space 6 of the tank 2 along a conduit 10. The compressor 12 is driven by an electric motor 14, for example, through a gear box (not shown). The electric motor 14 typically has a single speed and does not employ a frequency converter. The compressor 12 comprises two compression stages 16 and 18 in series. The downstream compression stage 18 has an outlet pressure in the order of 5 to 6 bar and an outlet temperature in the order of 30° C. Because LNG boils at a temperature well below 0° C., the inlet to the compressor 12 normally receives boiled-off natural gas at a cryogenic temperature, for example, minus 140° C. to minus 80° C. Notwithstanding this cryogenic temperature, it is desirable to cool the compressed natural gas intermediate the upstream compression stage 16 and the downstream compression stage 18. This cooling may be performed in a heat exchanger (not shown) having an inlet downstream of the outlet from the upstream compression stage 16 and an outlet upstream of the inlet to the downstream compression stage 18. The cooling medium at the prevailing subzero temperatures is a cryogenic stream of liquefied or vaporized natural gas in indirect heat transfer relationship with the compressed natural gas stream. Downstream of the heat transfer the coolant is returned to the tank 2 or introduced into a phase separator vessel 22. Alternatively, the cooling may simply be performed by introducing a cryogenic stream of liquefied or vaporized natural gas to the compressed natural gas at a region intermediate the upstream compression stage 16 and the downstream compression stage 18. With an appropriate rate of cooling the pressure at the outlet from the downstream compression stage 18 can normally be maintained at or close to a desired value.

It is desirable to keep the temperature at the inlet to the compressor 12 generally constant. However, the temperature of the natural gas boil-off can and does fluctuate according to the amount of LNG stored in the tank at any particular time and according to the external temperature. In order to compensate for such natural temperature fluctuations, a part or all of the natural gas flow through the conduit 10 is diverted via a flow control valve (not shown) to a static mixing chamber 20 where it is mixed with a chosen amount of LNG (which as shall be described below is taken from the volume 4 of LNG in the storage tank 2). Typically, the temperature at the outlet of the mixing chamber 20 is such that not all of the LNG evaporates. The resulting mixture of cold natural gas containing droplets of liquefied natural gas passes into the phase separator vessel 22 in which the liquid disengages from the gas. The liquid is returned via conduit 24 to a region of the storage tank 2 preferably below the liquid surface. As an alternative to return to below the liquid surface the conduit 24 may be equipped with a suitable siphon (not shown). The natural gas flows through an outlet 26 at the top of the vessel 22 and is remixed in the conduit 10 with any flow of boiled-off natural gas bypassing the static mixer 20, the remixing being performed at a location downstream of that from which the feed to the static mixing chamber 20 is taken. If desired, the phase separator 22 may be fitted at a region near its top with a pad 25 of absorbent material or of wire mesh which may absorb any residual droplets of LNG from the gas in the phase separator 22.

During certain transient operating conditions there are likely to be surges in the flow of the evaporated natural gas. In order to cater for such surges, an anti-surge conduit 17 extends between the outlet of the compression stage 18 and the inlet of the static mixer 20. A valve 19 is located in the conduit 17. In the event of a surge, the valve 19 opens and gas flows therethrough bypassing the compressor 12. The mixer 20 and the phase separator 22 may be operated during the transient operating conditions to remove heat of compression and to keep the suction pressure of the compressor 12 constant when there is a surge in the flow of evaporated natural gas.

Normally, the rate at which the engines 80 demand fuel is greater than that which can be met by natural vaporisation of the LNG in the storage tank 2. The deficit is made up by the forced vaporisation of LNG taken from the storage tank 2 or from another similar such tank. A submerged LNG fuel pump 30 continuously withdraws LNG from the volume 4 in the storage tank 2 at a constant rate. The resulting flow of LNG may be divided into four subsidiary streams. One is returned to the storage tank 2 via a conduit 32. A second flows via a conduit 34 to the static mixing chamber 20 and thus acts as the source of LNG for that chamber. A third, being the main flow of LNG, flows to a forcing vaporiser 36. The forcing vaporiser 36 is typically of a kind which employs steam heating to raise the temperature of the fluid flowing through a vaporisation chamber 37 thereof and thereby to vaporise the LNG supplied by the fuel pump 30. A nest 39 of heat exchange tubes is employed to effect the heat transfer from the steam to the LNG.

The forcing vaporiser 36 is provided with a by-pass line 38 which extends from upstream of the vaporiser 36 to a static mixing chamber 40 downstream of the forcing vaporiser 36. Accordingly, unvaporised LNG is mixed with the vaporised natural gas in the mixing chamber 40. The temperature of the vaporised natural gas can therefore be controlled according to the amount of LNG that by-passes the vaporiser 36. This temperature is selected so that the natural gas stream that exits the static mixing chamber 40 carries unvaporised LNG in the form of a mist or in other finely divided form. This LNG is disengaged from the carrier gas at a downstream location. Accordingly, the mixture of liquid and vapour flows from the chamber 40 into a phase separator 42 in which the liquid is disengaged from the vapour. The phase separator 42 is typically provided with a pad 43 of absorbent or of perforate metal members or the like so as to absorb any residual particles of liquid therefrom. The liquid may be withdrawn from the phase separator 42 through a bottom outlet 44 continuously or at regular intervals and returned to the tank 2 by appropriate operation and control of a valve (not shown) in the outlet 44. The resulting natural gas, freed of particles of liquid, passes out of the top of the phase separator 42 and at a low or cryogenic temperature is mixed with the natural gas from the compressor 12 at a region upstream of a gas heater 50.

There is a need to ensure that the composition of the fuel supplied to the engines 80 is always such as not to cause these engines to knock. In essence, this requirement imposes a need to limit the amount of higher hydrocarbons in the fuel. Natural gas is a variable mixture of nitrogen, methane and higher hydrocarbons. Normally, methane is the predominant component, generally providing more than 80 mole percent of the total composition. Methane is also the most volatile component of the natural gas. Accordingly, when LNG vaporises naturally the resultant vapour (boil off) consists essentially completely of methane and some nitrogen depending on the proportion of nitrogen in the LNG. However, forced vaporisation of a flow of LNG does not result in any change in composition. Therefore the product of the forced vaporisation will contain $C_2$ and higher hydrocarbons in the same proportions as in the LNG. Thus, the greater the need for forced vaporisation to make up the total flow rate of fuel to that demanded by the engines 80, the greater is the tendency for a fuel having too high a proportion of higher hydrocarbons to be formed from the mixture of natural boil off and forced gas. This tendency is counteracted in accordance with the invention by effectively conducting the forced vaporisation such that the fluid received by the phase separator 42 is only partially vaporised and therefore contains particles of liquid. Because methane is more volatile than the other hydrocarbons, the liquid particles contain a mole fraction of $C_2$ and higher hydrocarbons higher than in the vapour phase. The respective compositions of the vapour phase and the liquid phase in the phase separator 42 depend on the temperature of the fluid. The lower this temperature, the lower is the proportion of $C_2$ and higher hydrocarbons in the gas supplied from the phase separator 42. In one example, with a LNG fraction containing 3.85 mole percent of $C_3$ to $C_5$ hydrocarbons, forced vaporisation at minus 90° C. (that is to say with the temperature at the inlet to the phase separator 42 at minus 90° C.) produces a vapour fraction containing less than 0.5 mole percent of $C_3$ to $C_5$ hydrocarbons. Thus the bulk of the higher hydrocarbons are removed in the liquid phase.

The forcing vaporiser 36 desirably has a programmable logic controller 52 associated therewith. The controller 52 may be of a kind generally used in the process control art. It is typically programmed with an algorithm that determines the flow rate and temperature of the gas to be delivered to the phase separator 42. The arrangement is preferably such that an operator may simply enter the desired rate of supply of natural gas fuel to the engines 80 and the controller automatically sets the flow rate and temperature through the forcing vaporiser 36. In one example, the programmable controller has flow control valves 54, 56 and 58 associated therewith. The valve 54 sets the rate at which LNG is supplied by the pump to the interior of the forcing vaporiser 36. The valve 56 determines the rate of by-pass of LNG around the vaporiser 36 and therefore determines the temperature of the resultant gas. In the event that the fuel pump operates at in excess of the desired rate, the controller 52 controls the return of liquid to the tank 2 via the pipe 32 by appropriately setting the position of flow control valve 58. There is typically a fourth flow control valve 60 operatively associated with the static mixing chamber 20 so as to enable the necessary cooling of the natural boiled-off gas to be effected. This valve 60 may be controlled by means of a valve controller 62 which receives signals from a temperature sensor (not shown) typically located at or near the inlet to the compressor 12. Accordingly, the position of the valve 60 may be adjusted so as to ensure a constant desired temperature is obtained at the inlet to the compressor 12.

The programmable logic controller 52 also receives information about the real time flow rate of the natural boiled-off gas from the tank 2. Using this information the controller 52 can calculate how much natural gas needs to be supplied by forced vaporisation and then the temperature at which the mixing chamber 40 may be operated so as to ensure that the molecular weight of the gas supplied to the engines 80 is always below the permitted maximum and thereby to avoid engine knocking. In this way the methane number of the natural gas supplied to the engines can be adjusted.

Typically, the temperature of the gas that enters the heater 50 is well below 0° C. The heater is operated to raise the temperature of the gas to approximately ambient temperature, say 25° C. The gas is heated in the heater 50 by indirect heat exchange with steam (or other heating medium e.g. hot water) so as to raise its temperature to a desired value. Typically, the heater 50 is operated with a constant flow rate of heating fluid and the desired temperature reached by by-pass of the chosen amount of the cold gas around the heater 50. To this end, a by-pass conduit 72 is provided. In addition, there is a flow control valve 74 at the inlet to the heater 50 and a flow control valve 76 in the by-pass conduit 72. A valve controller 78 is provided so as to control the positions of the valves 74 and 76 such that the temperature of the gas provided by the heater 50 is maintained at the desired value of, for example, 25° C.

The gas mixture produced by the heater 50 is at a temperature and pressure such that it can be supplied directly to the engines 80. In the event of an emergency a valve 82 can open and the gas can be vented to a gas combustion unit 84.

The normal arrangement on a ship is that the phase separators 22 and 42, the compressor 12, the forcing vaporiser 36 and the gas heater 50 are all situated within a cargo machinery room (not shown) of the ship, whereas the engines 80 and the valve 82 are located within an engine room (not shown). The motor 14 may be located behind a bulkhead (not shown) in a motor room (not shown). The gas combustion unit 84 is typically located in the ship's funnel (not shown) away from both the cargo machinery room and the engine room.

Two typical examples of operation of the apparatus shown in the drawing are described hereinbelow, one being during laden operation (all tanks 2 being nearly full) and the other during ballast operation (all tanks being nearly empty).

Example 1

Laden Voyage

The tank 2 stores a volume of liquefied gas at a pressure of 106 kPa (in the ullage space 6). The natural boil-off rate is nearly 70% of that required to fuel the engines 80. In this example, the LNG has the following composition:

| | | |
|---|---|---|
| Nitrogen | 0.35 | mole percent |
| Methane | 88.00 | mole percent |
| $C_2$ Hydrocarbons | 7.80 | mole percent |
| $C_3$ Hydrocarbons | 2.80 | mole percent |
| $C_4$ Hydrocarbons | 1.00 | mole percent |
| $C_5$ Hydrocarbons | 0.05 | mole percent |

The average molecular weight of the LNG is therefore 18.41. A natural rate of boil-off of natural gas of 3489 kg/h occurs. The boil-off is assumed to have a composition of 90% by volume of methane and 10% by volume of nitrogen and flows into the conduit 10 at a temperature of minus 140° C. under a pressure of 106 kPa. At this low temperature no flow needs to pass the phase separator 22 via the static mixing chamber 20. The flow passes from the conduit 10 to the compressor 12 and leaves the compressor 12 at a pressure of 535 kPa and a temperature of minus 9° C. No interstage cooling is required between the compression stages 16 and 18 because the compressor discharge temperature is sufficiently low. The compressed gas is mixed with gas from the forced vaporiser. 1923 kg/h of LNG is supplied at a pressure of 800 kPa to the forcing vaporiser 36, a proportion by-passing this vaporiser according to the setting of the valves 54 and 56. The temperature of the LNG at the inlet to the vaporiser 36 is minus 163° C. The temperature of the gas which is provided to the phase separator 42 is minus 100° C. Its pressure is 530 kPa. 322 kg/h of heavier hydrocarbons are separated in the phase separator 42. The residual forcedly vaporised gas downstream of the phase separation has the following composition:

| | | |
|---|---|---|
| Nitrogen | 0.38 | mole percent |
| Methane | 94.74 | mole percent |
| $C_2$ Hydrocarbons | 4.66 | mole percent |
| $C_3$ Hydrocarbons | 0.21 | mole percent |
| $C_4$ Hydrocarbons | 0.01 | mole percent |
| $C_5$ Hydrocarbons | 0.00 | mole percent |

Average molecular weight 16.80

On being mixed with the gas supplied from the compressor 12, a flow of natural gas at a rate of 5090 kg/h, a pressure of 530 kPa and a temperature of minus 39° C. is formed. This natural gas mixture has the following composition:

| | | |
|---|---|---|
| Nitrogen | 7.00 | mole percent |
| Methane | 91.43 | mole percent |
| $C_2$ Hydrocarbons | 1.50 | mole percent |
| $C_3$ Hydrocarbons | 0.07 | mole percent |
| $C_4$ Hydrocarbons | 0.00 | mole percent |
| $C_5$ Hydrocarbons | 0.00 | mole percent |

Average molecular weight 17.11

This composition is suitable for use in the engines 80 as it has a sufficiently high methane number.

The mixed gas is heated in the heater 50 to a temperature of 25° C. and supplied at this temperature (and a flow rate of 5090 kg/h and under a pressure of 470 kPa) to the engines 80.

The programmable logic controller 52 operates so as to maintain a desired flow rate of gas to the engines 80 and to ensure that the composition of this gas is acceptable.

Example 2

Ballast Voyage

The nearly empty tank 2 stores a residual volume of liquefied natural gas at a pressure of 106 kPa (in the ullage space 6). The natural boil-off rate is approximately 30% of that required to fuel the engines 80. In this example, the residual LNG in the tank 2 has after the laden voyage the following composition:

| | | |
|---|---|---|
| Nitrogen | 0.16 | mole percent |
| Methane | 87.86 | mole percent |
| $C_2$ Hydrocarbons | 8.02 | mole percent |
| $C_3$ Hydrocarbons | 2.88 | mole percent |
| $C_4$ Hydrocarbons | 1.03 | mole percent |
| $C_5$ Hydrocarbons | 0.05 | mole percent |

The average molecular weight of the LNG is therefore 18.46. A natural rate of boil-off of natural gas of 1570 kg/h occurs. The boil-off is assumed to have a composition of 95% methane and 5% nitrogen and flows into the conduit 10 at a temperature of minus 100° C. under a pressure of 106 kPa. All of this flow passes to the phase separator 22 via the static mixing chamber 20 to adjust its temperature to a lower level. It is mixed with 78 kg/h of LNG supplied from the tank 2 via the flow control valve 60 by operation of the fuel pump 30. A resultant natural gas stream at a temperature of minus 115° C. and a flow rate of 1646 kg/h (2 kg/h are separated in separator 22) is obtained at the inlet of the compressor 12 and leaves the compressor at a pressure of 531 kPa and a temperature of 69° C. If desired, interstage cooling between the compression stages 16 and 18 may be applied to lower this temperature. The compressed gas is mixed with gas from the forcing vaporiser 36. 4168 kg/h of LNG is supplied at a pressure of 800 kPa to the forcing vaporiser 36, a proportion by-passing this vaporiser 36 according to the setting of the valves 54 and 56. The temperature of the LNG at the inlet to the vaporiser 36 is minus 163° C. The temperature of the gas which is provided to the phase separator is minus 100° C. Its pressure is 530 kPa. 724 kg/h of heavier hydrocarbons are separated in the phase separator 42. The forcedly vaporised gas downstream of the phase separation has a flow rate of 3444 kg/h and the following composition:

| | | |
|---|---|---|
| Nitrogen | 0.17 | mole percent |
| Methane | 94.91 | mole percent |
| $C_2$ Hydrocarbons | 4.71 | mole percent |
| $C_3$ Hydrocarbons | 0.21 | mole percent |
| $C_4$ Hydrocarbons | 0.01 | mole percent |
| $C_5$ Hydrocarbons | 0.00 | mole percent |

Average molecular weight 16.78

On being mixed with the gas supplied from the compressor 12, a flow of natural gas at a rate of 5090 kg/h, a pressure of 530 kPa and a temperature of minus 44° C. is formed. This natural gas mixture has the following composition:

| | | |
|---|---|---|
| Nitrogen | 1.57 | mole percent |
| Methane | 94.94 | mole percent |
| $C_2$ Hydrocarbons | 3.30 | mole percent |
| $C_3$ Hydrocarbons | 0.18 | mole percent |
| $C_4$ Hydrocarbons | 0.01 | mole percent |
| $C_5$ Hydrocarbons | 0.00 | mole percent |

Average molecular weight 16.75

This composition is suitable for use in the engines 80 as it has a sufficiently high methane number.

The mixed gas is heated in the heater 50 to a temperature of 25° C. and supplied at this temperature (and a flow rate of 5090 kg/h and under a pressure of 470 kPa) to the engines 80.

The programmable logic controller 52 operates so as to maintain a desired flow rate of gas to the engines 80 and to ensure that the composition of this gas is acceptable.

I claim:

1. An apparatus for supplying natural gas fuel, comprising: a compressor having a compressor inlet for receiving a primary stream of natural gas from an ullage space of at least one liquefied natural gas storage vessel, and a compressor outlet communicating with a natural gas supply pipe; a forced liquefied natural gas (LNG) partial vaporiser comprising a vaporiser inlet for receiving a secondary stream of natural gas from a liquid storage region of the liquefied natural gas storage vessel, and a vaporiser outlet in communication with the natural gas supply pipe downstream from the compressor, the forced liquefied natural gas partial vaporiser including: a vaporisation chamber having heat transfer means, an inlet to the vaporisation chamber for the liquefied natural gas, a mixing chamber downstream of and in communication with the vaporisation chamber, a first inlet to the mixing chamber in communication with an outlet from the vaporisation chamber, a second inlet to the mixing chamber in communication with a source of liquefied natural gas: means for disengaging unvaporised liquefied natural gas in communication and operatively associated with the mixing chamber; valve means for controlling relative flows of the liquefied natural gas to the vaporisation chamber and the mixing chamber; and a programmable logic controller operatively associated with the forced liquefied natural gas LNG partial vaporiser means, the programmable logic controller comprising an algorithm for determining a temperature at which the forced liquefied natural gas LNG partial vaporizer means is operated and for determining compositions of the unvaporised liquefied natural gas and the vaporized natural gas.

2. The apparatus according to claim 1, further comprising a gas heater for the natural gas supply pipe operable to raise the natural gas to a chosen temperature.

* * * * *